United States Patent [19]

Hughes, Jr.

[11] 4,017,995

[45] Apr. 19, 1977

[54] RANGE FINDING SIGHT

[75] Inventor: James B. Hughes, Jr., Houston, Tex.

[73] Assignee: Deep River Armory, Inc., Houston, Tex.

[22] Filed: Mar. 28, 1975

[21] Appl. No.: 563,083

[52] U.S. Cl. ..... 42/1 S; 33/251; 33/257

[51] Int. Cl.[2] ..... F41G 1/08; F41G 1/16

[58] Field of Search ..... 42/1 S; 33/233, 235, 33/251, 252, 254, 257

[56] References Cited

UNITED STATES PATENTS

| | | | |
|---|---|---|---|
| 266,206 | 10/1882 | Rowell | 33/252 |
| 433,323 | 7/1890 | Bunge | 42/1 S |
| 1,307,441 | 6/1919 | Frensdorf | 33/254 |
| 1,316,391 | 9/1919 | Scarr | 33/235 |
| 1,679,221 | 7/1928 | Kelm | 42/1 S |

FOREIGN PATENTS OR APPLICATIONS

| | | | |
|---|---|---|---|
| 10,607 | 6/1902 | United Kingdom | 33/257 |

*Primary Examiner*—Charles T. Jordan
*Attorney, Agent, or Firm*—William J. Beard

[57] ABSTRACT

A range finding gunsight suitable for military usage is provided having a rear portion with a baseplate member mounted for windage adjustment and having an integral upright member provided with an elongated oval shaped aperture. A slide member having a conventional circular peep aperture is mounted on the upright member and is vertically adjustable, the portion of the oval shaped aperture above the slide member defining a variable length sighting aperture. Two range scales, one on either side of the oval aperture, are scribed on the upright member. One scale may be used as a range indicator to a known height target which fills the variable aperture while the other range scale is keyed to the trajectory of the projectile fired by the arm. If the variable length sighting aperture is used to fire the arm, the arrangement is such that a hit on the known size target is assured if a correct sight picture is formed using it in conjunction with a conventional front blade sight. Otherwise the sight may be used as a conventional sight with the range set on the trajectory keyed scale once it is found using the range finding scale and the sight picture formed with the circular peep aperture and the front blade sight.

4 Claims, 4 Drawing Figures

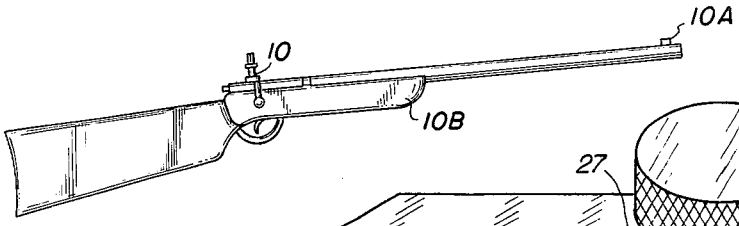
FIG. 1A
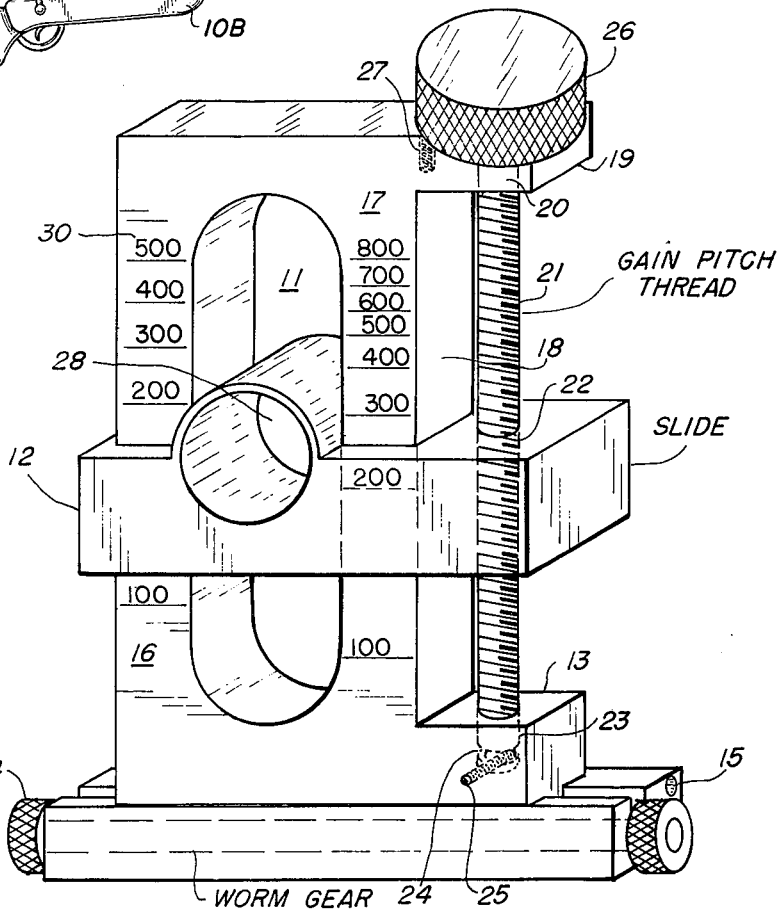
FIG. 1
FIG. 2
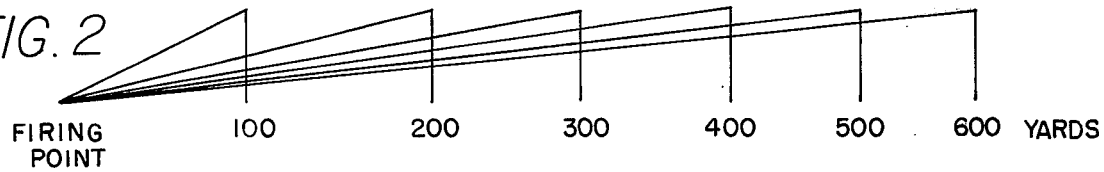
FIG. 3
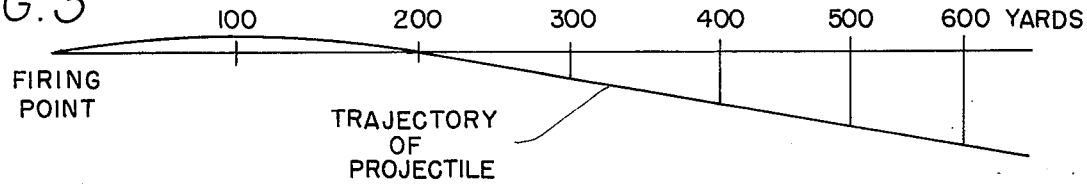

RANGE FINDING SIGHT

BACKGROUND OF THE INVENTION

This invention relates to sighting devices for firearms and more particularly to rugged lenseless or open sights which are suitable for use under combat conditions for military purposes.

Under adverse conditions of lighting and weather which are frequently encountered in military operations, gun sights which are complex in construction and operation can become severely burdensome to the user. Complex vernier sight adjustment mechanisms are prone to malfunction when dirty. Similarly, gunsights having optical components such as lenses are somewhat fragile and can become broken or fogged by the admittance of moisture, thereby rendering such sighting devices virtually useless. For this reason most gunsights authorized for military usage have traditionally been of the non-optical or open sight type. A fixed front blade sight having a brightened upper bead portion or having a plain square topped post has become almost universally accepted for such usage. Rear sight components have not become as uniform in acceptance, however. Relatively large circular aperture peep sights, V-shaped notches, square shaped notches, U-shaped notches and combinations of these shapes have all been accepted for military usage in conjunction with the usual front blade sight.

A common problem to all such open rear sights has been that of providing the sight with vertical and horizontal movement necessary in order to elevate the muzzle of the piece or translate it from side to side in order to correct for projectile trajectory and windage when a proper sight picture is obtained.

With prior type military open sights, in making correction for projectile trajectory, it has been necessary to have some prior knowledge or estimate of the range to the target. It has also been necessary to have prior knowledge of the trajectory characteristics of the projectile. With the projectile trajectory known and the target range known, it is then possible to elevate the open rear sight by an amount sufficient to raise the muzzle to allow for the fall of the projectile in passing from the piece to the target. It would be desirable to simplify and accelerate the procedure heretofore used for this purpose of making a range estimate and then elevating the rear aperture to correct for projectile trajectory.

Accordingly, it is an object of the invention to provide a simple and fast operating gunsight suitable for military usage which avoids the necessity of making a separate range to target estimation or measurement in its operation.

Another object of the invention is to provide a gunsight rugged enough in construction for military usage which is capable of providing a range estimate to a target.

The above and other objects, features and advantages of the invention are provided in a range finding gunsight. In the gunsight of the present invention, a conventional front blade sight near the muzzle of the piece is used. The rear portion of the sight comprises a rugged baseplate portion which is laterally translatable by means of a conventional worm gear to provide for windage adjustments. An upright sighting member having an elongated oval shaped sighting aperture therein and provided with a target range scale is integrally attached to the baseplate. A slide member comprising an opaque horizontal bar member having a fixed aperture circular peep is provided which is snugly but slideably fitted to the exterior portion of the upright sighting member. Vertical motion of the slide member is controlled by an adjusting screw having a knurled knob on one end thereof and which is rotatably mounted on one side of the upright sighting member. The opposite end of the adjusting screw is provided with a rotatable end mount in the base member.

The area above the horizontal bar member within the elongated oval shaped sighting aperture is increased or decreased in length as the slide member is moved vertically along the upright sighting member and thereby defines a variable length oval shaped sighting aperture. The arrangement is such that when a target whose height is approximately known completely fills the length of the variable length oval sighting aperture, the range to the target may be read from the range scale. Also, if a conventional sight picture is taken at this time (for example, with the front blade filling half the elongated oval aperture), then the trajectory of the projectile in passing from the piece to the target is compensated for in the sense that the projectile will strike someplace on the known sized target.

Other advantages of the invention will be apparent from the detailed description to follow. The invention may best be understood by reference to the detailed description herein when taken in conjunction with the accompanying drawings, in which:

BRIEF DESCRIPTION OF THE DRAWINGS

FIG. 1 is a perspective three dimensional schematic drawing depicting the rear sight portion of the gunsight of the present invention;

FIG. 1A shows the sight mounted on an arm having a barrel and receiver.

FIG. 2 is a diagram illustrating the angular size variation of a known size target at various rages; and FIG. 3 is a diagram schematically illustrating a typical projectile trajectory.

DETAILED DESCRIPTION OF THE INVENTION

Referring initially to FIG. 1, the rear sight portion of the present invention is shown in a schematic perspective view. This rear sight 10 is used in conjunction with a conventional blade type front sight 10A on the firearm 10B. A correct sight picture is formed and the piece ready to be fired when the blade front sight 10A is centered in the variable length oval shaped sighting aperture 11 above the horizontally disposed slide member 12 and when this blade extends vertically approximately one-half the variable vertical extent of the elongated oval shaped sighting aperture 11.

The adjustable rear sight of FIG. 1 has a base plate portion 13 which is translatable laterally to make windage corrections by means of a conventional worm gear screw 14. Base plate 13 is slideably mounted for this purpose along a mounting bear (not shown) which passes through a mounting hole 15 sized appropriately. As this arrangement is known conventionally in the art, details of this mount are not included herein for purpose of clarity. Other alternate arrangements such as a dovetail slide fit of base plate 13 for drive by worm gear screw 14 rather than a mounting bar through mounting hole 15 are conventional and are deemed to be within the scope of the invention.

An upright sighting member 16 is provided which is integral with base plate member 13. This upright member 13 is provided with an elongated oval shaped aperture portion 11 and is scribed, for example on one edge thereof, with a range scale 17. The right edge 18 of upright member 16 is provided at its upper end with a horizontal extension 19. Extension 19 has a hole 20 bored therein which is sized to allow passage therethrough of an adjusting screw 21. Adjusting screw 21 has a gain pitch thread thereon whose pitch increases in the downward direction. The screw 21 passes vertically through the hole 20 and a vertical bore 22 in slide member 12 which is appropriately threaded internally to coact with the gain pitch thread of adjusting screw 21. The upper end of adjusting screw 21 is provided with a knurled handle 26 to allow easy turning of the screw 21. The lower end of adjusting screw 21 terminates in a hole 23 in base plate member 13 where it is provided with a grooved portion 24 which is sized to accept a retaining screw 25. Thus, the adjusting screw 21 is rotatably mounted so that it may be turned freely in either direction. The underside of the knurled head portion 26 of screw 21 is provided with a plurality of radial serrations (not shown). A spring loaded detent 27 is urged into these radial serrations, thus providing a "click adjustable38 feature to adjusting screw 21 and providing a frictional force to hold the screw 21 at the desired adjustment location. The gain pitch thread of the screw 21 is chosen so as to make each "click" of detent 27 correspond to a fixed length range increment such as 25 yards at whatever range is indicated on scale 17.

As hereinbefore described, the vertical hole 22 in slide member 12 is threaded internally to coact with adjusting screw 21 to thereby enable the slide member 12 to be moved vertically in either direction along the upright sighting member 16. Additionally, the upper edge of slide member 12 is provided with a fixed peep aperture 28 on the portion thereof interior to the elongated oval shaped aperture 11 of sighting member 16. Thus, as the slide member 12 is moved vertically along upright sighting member 16 a variable length elongated oval shaped sighting aperture 11 is defined by the lower edge of the peep aperture 28 and the upper edge of the elongated oval aperture 11. This variable length aperture is used for range estimation as will be described.

Referring now to FIG. 2, the apparent angular size of a fixed height target at different ranges is illustrated schematically. The angular size of this image (provided the fixed height is small with respect to the actual range) decreases in inverse proportion to the range. That is (for small angles), the angular size at 200 yards is one-half the angular size at 100 yards, at 300 yards, one-third the angular size at 100 yards, etc. At 100 yards a 1 inch target subtends an arc of approximately 1 minute. Or, stated another way, 1 minute of arc elevation of the muzzle of an arm will result in a 1 inch increase in height of the striking point of a fired projectile from that arm at 100 yards (for constant trajectory projectile).

Similarly, FIG. 3 shows schematically the trajectory of a projectile for an arm which is "sighted in" at 200 yards. It will be noted that at ranges below 200 yards that the projectile is above the line of sight while at ranges greater than b 200 yards the projectile is below the line of sight. Table 1 below shows trajectory tables for three typical military small arm rounds sighted in at 200 yards in terms of range and angular equivalent trajectory at that range.

TABLE I

| Projectile | 100 yds | 200 yds | 300 yds | 400 yds | 500 yds |
|---|---|---|---|---|---|
| .223 caliber (5.56mm) 55 Gr. 3240 ft/sec | in. +1.8 in. | 0 | −8.2 in. | −25.5 in. | −56 in. |
| | +1.8 min. | 0 | −2.7 min. | −6.4 min. | −11.2 min. |
| .308 caliber 150 Gr. 2820 ft/sec | +1.9 in. | 0 | −9.1 in. | −26.9 in. | −55.7 in. |
| | +1.9 min. | 0 | −3.3 min. | −6.7 min. | −11.1 min. |
| .30–06 caliber 150 Gr.2910 ft/sec | +2.0 in. | 0 | −8.0 in. | −23.3 in. | −47.5 in. |
| | +2.0 min. | 0 | −2.7 min. | −5.8 min. | −9.5 min. |

Now, in the operation of the present invention, the length of the variable length oval shaped sighting aperture 11 is chosen so that a particular height target fills the aperture at 100 yards. It will be apparent that a suitable size is arbitrary depending on the distance from the shooter's eye to the rear sight. Then, as the slide is raised to accommodate the shrinking angular size of such a target so that the target completely fills the variable length aperture 11 at whatever range it is located, the muzzle of the piece is elevated if the sight picture of the target is kept the same as previously described regardless of range.

For example, if a known 72 inch high target is chosen to completely fill the length of the variable oval sighting aperture at 100 yards, Table II below gives the angular muzzle elevation obtained at various ranges when the variable length oval aperture is adjusted by means of adjusting screw 21 (FIG. 1) to maintain the "filling" relationship at the various ranges and assuming the piece is sighted in to zero at 200 yards range.

TABLE II

| Range to Target (Yards) | Target Angular Size | Angular Elevation C Caused Bringing Slide to "Filling" Condition |
|---|---|---|
| 100 | 72 min. | −18 min. |
| 200 | 36 min. | 0 |
| 300 | 24 min. | +6 min. |
| 400 | 18 min. | +9 min. |
| 500 | 14.4 min. | +10.8 min. |

By comparing the last column of Table II with the projectile trajectories of Table I it is apparent that if the initial sight in of the piece is made at 200 yard range, then out to 500 yards the angular elevation of the muzzle of the piece caused by "filling" the variable length oval sighting aperture 11 actually overcompensates in most cases for the trajectory of these typical military projectiles. Table III below illustrates this for the three projectiles listed in Table I.

TABLE III

| | Net Over-Under Compensation .223 Cal. | Net Over-Under Compensation .308 Cal. | Net Over-Under Compensation .30–06 Cal. |
|---|---|---|---|
| 100 yds | −16.2 min. or −16.2 in. | −16.1 min. or −16.1 in. | −16 min. or −16 in. |
| 200 yds | 0 min. or 0 in. | 0 min. or 0 min. | 0 min. or 0 in. |
| 300 yds | + 3.3 min. or + 9.9 in. | + 2.7 min. or + 7.1 in. | + 4.3 min. or +12.9 in. |
| 400 yds | + 2.6 min. or +10.4 in. | + 2.3 min. or + 9.2 in. | + 3.2 min. or +12.8 in. |
| 500 yds | − .4 min. or − 2.0 in. | − .3 min. or − 1.5 in. | + 1.3 min. or + 6.5 in. |

Table III further illustrates the fact that if the initial 200 yard sight in of the piece is performed with respect to the center of a 72 inch target, that for these projectiles at all ranges from 100 to 500 yards the projectile will still strike near the center of the 72 inch target. The worst case in all of these projectiles occurs at 100 yards range where all of the projectiles will strike approximately 16 inches low. This will still be on the target.

In operation of the gunsight of the present invention then, where a target whose approximate height is known is visible, adjusting screw 21 is turned until this known size target just fills the variable length oval sighting aperture 11 formed by the bottom portion of peep aperture 28 of slide member 12 and the top of elongated oval shaped aperture 11. Then a correct sight picture is obtained using the front blade sight and the variable length oval aperture 11, and the piece is fired. The user is assured of hitting within the indicated distances of Table III from the center of the target.

Moveover, by use of the bottom edge of slide member 12 as an indicator, the approximate range to a known size target may be read directly off the range scale 17 on the upright member 16. If desired, the piece may be conventionally sighted using the fixed size circular peep 28 and a second range scale 30 on the opposite side of upright member 16 from the range finding scale 17. In this case the range scale 30 is keyed solely to the projectile trajectory of the piece and sight pictures are formed (once the range has been determined from use of the "filling" relationship of a known size target and scale 17) solely by use of the circular peep 28 in conjunction with the front blade.

It will be appreciated that the foregoing description may render other alternative embodiments of the invention apparent to those skilled in the art. It is therefore the aim of the appended claims to cover all such changes and modifications as fall within the true spirit and scope of the invention.

I claim:

1. An open gunsight of rugged construction and suitable for military usage on a firearm having a barrel and a receiver, comprising:

an upright front blade sight portion fixedly mounted on a muzzle end of a firearm;

a rear sight portion laterally translatably mounted toward the receiver end of the barrel of a firearm and comprising a baseplate member and an upright member integral therewith, said upright member having an elongated aperture coextensive over at least a portion of its vertical extent and interior from its transverse edges, a slide member moveably mounted on said upright member over at least a portion of its vertical extent by a co-acting variable pitch screw member, the portion of said aperture above said slide member defining a variable length aperture, said screw member being rotatably attached to one edge of said upright member and terminating in a rotatable mount in said baseplate member, said upright member being provided on one edge face thereof toward the receiver end of the firearm with a first range scale keyed to the apparent angular extent of a predetermined known sized target whereby when the known sized target is observed through said variable length aperture and said screw member turned to move said slide member until the target height completely fills the vertical extent of said variable aperture, the range to the target may be read off from said range scale, and wherein said screw member is provided on the upper end thereof with a knob portion having on its underside surface a plurality of radially extending serrations which are sized to cooperatively engage a spring loaded detent member housed in the upper edge of said upright member and wherein the variable pitch of said screw member and the separation of said radial serrations are chosen in conjunction with said first range scale so that as said knob is turned and said spring loaded detent jumps from one radial serration into another, each such jump or angular rotation of said knob represents a predetermined interpolation distance between distance marks on said first range scale.

2. The gunsight of claim 1 wherein the components are sized such and the rear sight portion mounted on the arm a suitable arbitrary distance from the eye of the shooter so that when a sight picture is formed using said front blade member and said variable length aperture in a predetermined conjunctive relationship to each other and when said slide member is adjusted until the known height target completely fills the vertical extent of said variable aperture, that a hit from a typical military small arm projectile having a known trajectory is assured on at least some portion of the vertical extent of the known height target.

3. The gunsight of claim 1 and further including, on the opposite edge face of said upright member from said range scale a second range scale keyed to the trajectory of a known small arm projectile.

4. The gunsight of claim 3 wherein said slide member is additionally provided on the upper vertical edge portion thereof with a relatively smaller diameter than the width of said variable aperture, circular peep aperture, whereby said circular peep aperture and said front blade portion may be used in a predetermined conjunctive relationship with each other to form a sight picture for use in aiming the arm in conjunction with said second range scale.

* * * * *